US010538083B2

(12) United States Patent
Muhl et al.

(10) Patent No.: US 10,538,083 B2
(45) Date of Patent: Jan. 21, 2020

(54) PROCESSING APPARATUS FOR INDIVIDUAL ITEMS, HAVING AN INKJET PRINT HEAD, AND AN ACTIVATION METHOD THEREFOR

(71) Applicant: Francotyp-Postalia GmbH, Berlin (DE)

(72) Inventors: Wolfgang Muhl, Hohen Neuendorf (DE); Karsten Von der Waydbrink, Potsdam (DE); Volker Baum, Berlin (DE)

(73) Assignee: Francotyp-Postalia GmbH, Berlin (DE)

( * ) Notice: Subject to any disclaimer, the term of this patent is extended or adjusted under 35 U.S.C. 154(b) by 0 days.

(21) Appl. No.: 16/169,120

(22) Filed: Oct. 24, 2018

(65) Prior Publication Data

US 2019/0118531 A1 Apr. 25, 2019

(30) Foreign Application Priority Data

Oct. 24, 2017 (DE) ..... 20 2017 106 430 U
May 4, 2018 (DE) ..... 10 2018 110 726

(51) Int. Cl.
*B41J 2/165* (2006.01)
*B41J 2/045* (2006.01)
(Continued)

(52) U.S. Cl.
CPC ..... *B41J 2/04556* (2013.01); *B41J 2/04586* (2013.01); *B41J 2/145* (2013.01);
(Continued)

(58) Field of Classification Search
CPC ..... B41J 11/00; B41J 11/0005; B41J 13/12; B41J 2/1752; B41J 2/16517; B41J 2/175; B41J 25/001; B41J 15/00; B41J 11/42; B41J 11/425; B41J 11/44; B41J 11/46; G07B 17/00193
See application file for complete search history.

(56) References Cited

U.S. PATENT DOCUMENTS 6,106,095 A 8/2000 Jackson et al.
10,081,187 B2 9/2018 Baldi et al.
(Continued)

FOREIGN PATENT DOCUMENTS

DE 20 2014 102 699 U1 6/2014
DE 20 2017 106 450 U1 10/2018

*Primary Examiner* — Kristal Feggins
(74) *Attorney, Agent, or Firm* — Schiff Hardin LLP

(57) ABSTRACT

In a processing apparatus, with an inkjet print head, that processes individual items, a drive motor that operates a transport mechanism to transport the individual items in the x-direction of a Cartesian coordinate system past the inkjet print head in a printing position so as to execute a printing operation with the inkjet print head on each individual item. The drive motor arrangement also moves the inkjet print head in the y-direction into a first position that is any of an exchange position, the printing position, a cleaning position or a sealing position. The drive motor arrangement also moves the inkjet print head vertically, in the z-direction of the exchange position or the sealing position, into at least one other position that is either the printing position or the cleaning position.

18 Claims, 8 Drawing Sheets

(51) Int. Cl.

| | |
|---|---|
| ***B41J 2/175*** | (2006.01) |
| ***G07B 17/00*** | (2006.01) |
| ***B41J 2/145*** | (2006.01) |
| ***B41J 25/00*** | (2006.01) |

(52) U.S. Cl.
CPC ..... *B41J 2/16508* (2013.01); *B41J 2/17523* (2013.01); *B41J 25/006* (2013.01); *G07B 17/00508* (2013.01); *G07B 2017/00532* (2013.01)

(56) References Cited

U.S. PATENT DOCUMENTS

| | | | | |
|---|---|---|---|---|
| 2013/0335497 | A1 | 12/2013 | Orlmann et al. | |
| 2015/0116394 | A1 | 4/2015 | Izuo | |
| 2015/0202904 | A1 | 7/2015 | Okuda | |
| 2015/0298475 | A1* | 10/2015 | Kuypers | B41J 2/16535 347/19 |
| 2017/0266962 | A1* | 9/2017 | Tamura | B41J 2/04541 |
| 2017/0341423 | A1* | 11/2017 | Schnepp | B41J 2/16508 |

* cited by examiner

PROCESSING APPARATUS FOR INDIVIDUAL ITEMS, HAVING AN INKJET PRINT HEAD, AND AN ACTIVATION METHOD THEREFOR

BACKGROUND OF THE INVENTION

Field of the Invention

The present invention concerns a processing apparatus for individual items, which has an inkjet print head for printing an imprint on the individual items. The invention also concerns an activation method for operating such a processing apparatus.

Description of the Prior Art

As discussed below, individual items to be processed each constitute a print medium, which can be any of flat items, mail pieces, letter envelopes, postcards and the like.

U.S. Pat. No. 6,106,095 discloses a franking machine with two ½-inch inkjet print heads, which requires a printing of a franking imprint. Since each of the two ½-inch inkjet print heads prints only one half of the franking imprint, an alignment of both imprint halves is necessary. Since the two ½-inch inkjet print heads are offset not only transverse to the transport direction of the mail piece but also longitudinally in the transport direction of the mail piece, a necessary time offset is achieved by a time delay circuit. The variation in the activation of the print heads relative to one another is easily perceptible from the position of the two imprint halves of the print image of a predetermined print image. The control system prints a test pattern onto a surface of the mail piece and ensures that the print data signals that are sent to the pair of inkjet cartridges are coordinated so that they generate a qualitatively high-grade imprint of the print image. However, the adjustment of the standard time delay by a user of a franking machine to achieve such a qualitatively high-grade imprint is time-consuming and differs from operator to operator. Each of the two ½-inch inkjet print heads is supplied by a respective ink cartridge that has a limited ink capacity. After exchanging consumed ink cartridges, ink cartridges filled with ink may be inserted into a print carriage of the printer module that has a sled that runs on two rails, moving in a plane transverse to the transport direction of the mail piece. The adjustment of the standard time delay must be performed after every exchange of one of the two ½-inch ink cartridges. The franking machine includes an arrangement for repositioning the sled with respect to its transverse movement, and has a service assembly. The latter can be moved only perpendicularly to the transverse movement of the sled. For this purpose, it is driven by a separate motor and may be moved in the transport direction and counter thereto. The service assembly may be advanced by a sliding block guide toward the print heads when the sled is positioned in a service position. The service assembly and its drive thus do not have a simple design. Moreover, in a printing position the distance of the print heads above the print medium cannot be varied. This is disadvantageous if the print medium does not have a smooth surface but instead has a coarsely structured or corrugated surface. Since a 1-inch inkjet print head was not yet available at the time this franking machine was designed, only ½-inch ink cartridges could be used.

More recently, high precision even for printing to a larger print width is possible with modern methods based on a silicon wafer technology for production of the nozzles in a nozzle plate (side shooter principle), as described in EP 2 576 224 B1.

In 2017, Pitney Bowes publicly announced a franking machine with a 1-inch inkjet print head, called the Send-Pro® C200-type franking machine. The 1-inch inkjet print head cannot be moved vertically in this machine.

In the PostBase®-type franking machine that is commercially available from Francotyp-Postalia GmbH, in order to generate imprints, a print medium is pressed by a contact pressure device against an ink printing device that contains a transport module that transports the print medium in a transport direction x (of a Cartesian coordinate system) during the printing. The ink printing device has a print carriage with at least one exchangeable ink cartridge.

The at least one ½-inch ink cartridge is equipped with an ink print head that can be moved in the direction y, thus transversely to the transport direction x by the print carriage for the purpose of servicing. As is known, the print carriage of the PostBase®-type franking machine requires at least one ink cartridge mount and a sled that is installed so as to be movable in the y-direction on two guide rods. The guide rods are linear bearing and guidance elements for the sled. The guide rods are arranged in a frame so as to be transverse to the transport direction x of the print medium, are situated parallel to one another at a constant distance that extends in the transport direction x, and extend longitudinally in a direction y of the Cartesian coordinate system that is perpendicular to the transport direction x. The sled that can be moved transversely to the transport direction x is driven by a stepper motor via a threaded spindle and may be driven into an exchange position at the front side of the franking machine (U.S. Pat. No. 8,262,178 B2, FIG. 3).

The guide rods establish the distance of the nozzle plate of the ink print head relative to the surface of the print medium that is to be printed. The surface of the print medium will actually deviate within the print medium from a planar surface into a spherical surface, depending on the material of the print medium and its padding, which may lead to an indistinct imprint.

However, problems may occur given a subsequent use of other types of inkjet print heads or ink cartridges. Space problems thus may occur in the frame of a PostBase®-type franking machine if use of a 1-inch print head is now desired, because the frame was originally designed for a use of ½-inch ink cartridges (from Hewlett Packard) that have different external dimensions.

From the U.S. Pat. No. 9,177,424 B2, it is known to provide a respective cleaning and sealing station (RDS) for each ½-inch ink cartridge. The RDS has a sealing cap and may be driven onto the ½-inch inkjet print head. The RDS is installed in a lower housing shell of the processing apparatus so as to be exchangeable via a lockable service opening.

In German Utility Model DE 20 2017 106 430.1 (not previously published), a processing apparatus for individual items is described that has a single inkjet print head for printing on a print medium or flat good. The processing apparatus may be designed as a franking machine having a single inkjet print head, wherein the franking imprint is at least 1 inch wide. The print medium is pressed by a contact pressure device onto a transport module of the ink printing device and transported in a transport direction x during the printing. The printing module is arranged so as to be stationary during printing, and has a print carriage having an ink cartridge receptacle for an exchangeable ink cartridge, an inkjet print head. A sled of the printing module can be driven transversely to the transport direction x (thus in the y-direction of the Cartesian coordinate system) and counter thereto for the purpose of servicing. The printing module is designed to displace the single inkjet print head, in a vertical z-direction (orthogonal to the transport direction x) of the Cartesian coordinate system so as to print an imprint of at least 1 inch in width, and is also displaceable counter thereto. The sled can be driven to different positions in the y-direction, controlled by a control processor of the processing apparatus. Movement data for at least a part of the print module are stored in a non-volatile manner in a memory of the control processor. The aforementioned part of the print module is referred to as a print carriage in the following, and can be moved in the z-direction and counter thereto, corresponding to the movement data. The space problem given use of a 1-inch inkjet print head in a Post-Base®-type franking machine in theory could be overcome by mechanical and electromechanical components designed so as to be in large part removable, but additional problems that still must be overcome would occur in the control of the print module.

SUMMARY OF THE INVENTION

An object of the invention is to remedy the defects of the aforementioned known solutions and to develop an activation method for a processing apparatus for individual items, having an inkjet print head, as well as a processing apparatus for implementing such an activation method.

A further object is to improve the precision in the printing of an imprint by the inkjet print head. Before printing, a corresponding movement of the inkjet print head should be enabled in order to increase the precision of the adjustment of the distance of the nozzle plate of the inkjet print head above the print medium.

An additional object that exists is to provide a defined sequence of steps in order to be able to move the inkjet print head out of a defined base setting into a predetermined position, and from the latter into a different predetermined position, with a high positional accuracy.

The invention causes the control processor to interact with actuators and sensors that are attached to suitable components of the processing apparatus. Another object is to achieve a workflow for positioning of the moving parts of the printing device in a defined base setting after an activation of the power supply of the processing apparatus.

The existing printing mechanism should continue to be utilized, and the processing apparatus should be equipped with electromechanical and mechanical components that can be easily removed. At the same time, the servicing should be further improved. A simpler, and thus more cost-effective, service device for the printing device of the processing apparatus should thereby be achieved, which enables a precise adjustment of the distance between wiping lip mount of the service station and the nozzle plate of the ink print head, in order to optimize the overlap of the wiping lip with the nozzles of the nozzle plate.

In accordance with the invention, an activation method for a processing apparatus for individual items, which are transported in the x-direction of a Cartesian coordinate system, controls movement of an inkjet print head so as to drive the inkjet print head to different predetermined positions that are spaced apart from one another in the y-direction of the Cartesian coordinate system. In addition to movement of the inkjet print head from an exchange position or sealing position into at least one other position, in particular a printing position or a cleaning position, an activation of a drive motor is operated to generate a vertical movement of the inkjet print head.

The printing position is a position of the inkjet print head at which a printing operation takes place, i.e., printing an imprint on one of the individual items that is moved in the transport direction. The cleaning position is a position at which a cleaning operation of the inkjet print head takes place. As discussed below, an exchange position of the inkjet print head is a position at which an exchange operation takes place in order to exchange the ink cartridge that supplies the inkjet print head. A sealing position is a position at which a sealing operation takes place in order to produce a seal around the inkjet print head.

A sub-program of the activation method for vertical displacement of the print carriage of the printing module is called repeatedly in the program, so the activation of the drive motor takes place programmatically. The sub-program of the activation method for vertical displacement of the print carriage is called in at least one program step of the program. An activation reference is provided in order to also obtain position information in the event that this information is absent in a memory. When it is clear at precisely which position the print carriage is located at the point in time of activation, the print carriage can be moved into a different position.

As noted, the processing apparatus is equipped with an inkjet print head. Before a printing, the inkjet print head is situated so that it can be moved transversely to the transport direction x for print media each lying on their side (transverse displacement direction), but it is stationary during the printing. Before the printing, a first drive motor and a second drive motor are electrically connected with a control processor for their activation. Moreover, sensors for position detection that are electrically connected with the control processor are provided. The control processor is programmed to generate two-dimensional movement of the inkjet print head orthogonal to the transport direction x of the print medium. A movement mechanism is arranged to vertically raise and lower a print carriage with the inkjet print head in a frame of the processing apparatus, the frame being non-positively coupled with the first drive motor. In addition to a movement of the inkjet print head from an exchange position or sealing position, the movement mechanism can be driven into at least one of the printing position or cleaning position in order to execute a vertical movement of the inkjet print head.

Movement data are stored in a non-volatile memory of the control processor of the processing apparatus. The movement data are retrieved by the control processor from the memory in a position-dependent manner depending on the current position of the printing module, and depending on the respective new position to which the printing module should be moved. The movement data include a movement direction, parameters for motor control, and termination criteria for the programs for movement of the printing module into at least one other position. The parameters for motor control are chosen depending on the type of drive motor. The movement data are defined by y-coordinates as well as z-coordinates that are required for a movement of at least one part of the printing module in the z-direction. Such a part of the printing module is the print carriage, which supports the inkjet print head and can be moved vertically, thus in the z-direction or counter thereto. The movement data comprise parameters for control of the first drive motor, so as to enable a vertical movement of the inkjet print head out of one position into another position. A two-dimensional movement of the inkjet print head is enabled by combined operation with the second drive motor at a frame of the processing apparatus, and the activation method includes movement of a sled of the printing module in the y-direction and counter thereto. After querying the events determined during the movement, and the stored y-coordinates of the movement data that are stored associated with predetermined positions, a check is made as to whether the inkjet print head should be moved vertically. Given a positive answer of the query, the drive motor is activated which execute the vertical movement.

The ink printing device of the processing apparatus has a printing module that is stationary during the printing. The printing module serves to generate imprints on a print medium moved in the transport direction x, and has a single inkjet print head. The printing module is accordingly designed to displace the single inkjet print head in the y-direction and counter thereto, transverse to the transport direction x, and to move it vertically, namely in an orthogonal z-direction and counter thereto. The printing module thereby enables a movement of the inkjet printing device in two dimensions.

The processing apparatus having a single inkjet print head allows an imprint of at least 1 inch in width to be printed onto the print medium, with the print medium being moved in the transport direction x during the printing.

The processing apparatus has a movement mechanism to vertically raise and lower the 1-inch inkjet print head in the z-direction and counter thereto. The 1-inch inkjet print head is a component of a 1-inch ink cartridge that is installed so as to be insertable into the ink cartridge mount. The 1-inch ink cartridge is installed under a lockable flap in an opening of an upper housing shell of the goods processing apparatus so that the 1-inch ink cartridge can be exchanged and is accessible from above. Raising and lowering of the 1-inch inkjet print head relative to the service station or the print medium to be printed, and for a cartridge exchange, can be realized by the movement mechanism installed in a frame of the processing apparatus. The 1-inch inkjet print head can be sealed to prevent drying out, by a cleaning and sealing station (RDS). The RDS has a stationary sealing cap and likewise is installed in a lower housing shell of the processing apparatus (as described in U.S. Pat. No. 9,177,424 B2) so that it can be exchanged again via a service opening that can be locked by a flap.

Due to the movement mechanism, the 1-inch inkjet print head can be coupled with the RDS without a raising of the RDS being required. The structure of the service station (RDS) is thereby advantageously simplified. Moreover, the clearance of the 1-inch inkjet print head between the stationary service station can be set differently, so that the relation to the wiping lip can be set precisely.

The precision in the printing of an imprint is further increased by the use of the single 1-inch wide inkjet print head. Compared to a use of two ½-inch inkjet print heads in a printing module, the problems with the alignment of imprint halves of a print image obviously do not apply if only a single inkjet print head having a print width of 1 inch is used instead of two ½-inch inkjet print heads.

The inkjet print head cannot only be positioned transversely to the transport direction of the print medium, but moreover can be precisely positioned, by a movement mechanism, at a distance from the surface to the print medium that is to be printed. The advantageous precision of the adjustment of the distance of the 1-inch inkjet print head over the print medium contributes to the improvement of the imprint. The movement mechanism for raising and lowering the 1-inch inkjet print head has components for motorized movement of the 1-inch inkjet print head in the vertical direction z of the Cartesian coordinate system, orthogonal to the transport direction x, and counter thereto, and also has components for vertical manual displacement of the 1-inch inkjet print head.

Multiple different displacement positions can be achieved given a motorized movement of a lifting beam of the apparatus, wherein each displacement position corresponds to a predetermined vertical clearance of the 1-inch inkjet print head in the z-direction relative to the surface of the print medium to be printed to, or relative to the service station. The movement mechanism allows a raising and lowering of the 1-inch inkjet print head. That has the advantage that the service station may be of simple design since this needs to be neither lowered nor raised.

The control processor of the processing apparatus is operationally connected at least with the non-volatile memory and with a read-only memory, as well as with an input/output circuit. The input/output circuit is electrically connected with the sensors of the processing apparatus in order to receive sensor signals, and is connected in terms of control with first, second, and third drive motors. The first drive motor is provided for components that execute a predetermined vertical movement when the drive motor is activated accordingly.

An activation program for the movement of the inkjet print head is stored in the read-only memory, and movement data for at least one part of the printing module is stored in a non-volatile manner in the non-volatile memory of the control processor. The part of the printing module that is called a print carriage can be moved in the z-direction and counter thereto, corresponding to the movement data, and the sled of the printing module can be moved in the y-direction or counter thereto, corresponding to the movement data. The activation method for the processing apparatus having a moveable inkjet print head assumes that the latter is moved into different predetermined positions in the y-direction and counter thereto by the sled, and into different predetermined positions in the z-direction and counter thereto by the print carriage, corresponding to the movement data.

DESCRIPTION OF THE PREFERRED EMBODIMENTS

A known processing apparatus for individual items, when viewed from the front (not depicted in the Figures) transports each print medium from left to right during the printing. The term "right" as used herein means in the transport direction x of a print medium, or downstream, and the term "left" thereby means counter to the transport direction x of the print medium (not shown), or upstream. The term "behind" as used herein means in the y-direction, and "before" means counter to the y-direction, and "above" means in the z-direction of a Cartesian coordinate system, and "below" means counter to the z-direction. The terms such as leading edge, trailing edge, upper edge, and lower edge of a switching flag are to be understood equally.

The exemplary embodiment assumes such a processing apparatus, but processing apparatuses are not precluded that transport print media from right to left during the printing.

In a perspective depiction from the rear, the terms "right" and "left" are swapped. Therefore, in the following the terms "downstream" and "downstream" are used in order to make clear when such swapping is not intended.

Figure 1:
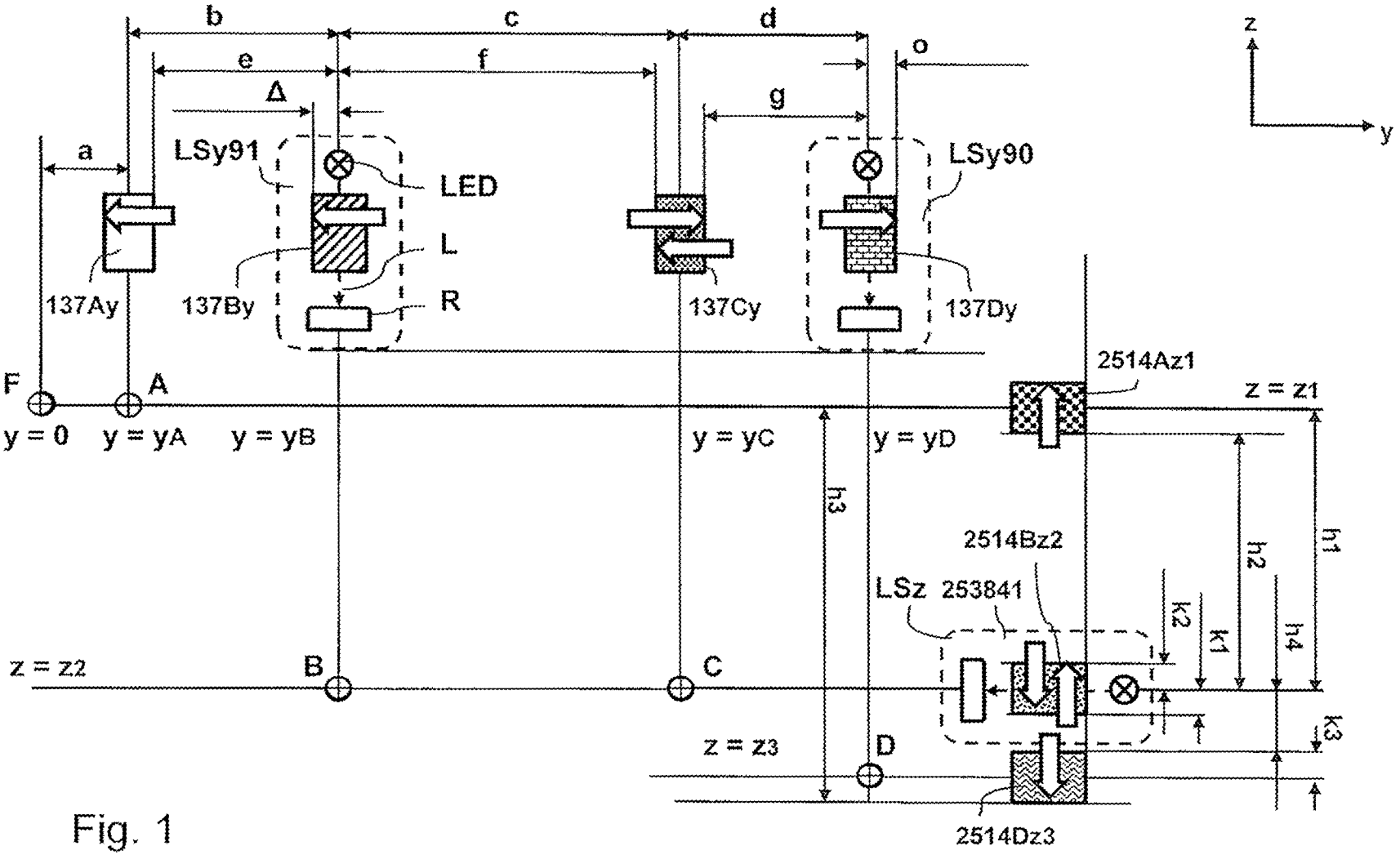
FIG. 1 schematically depicts movement states of a printing module having an inkjet print head in a processing apparatus according to the invention.
Figure 2:
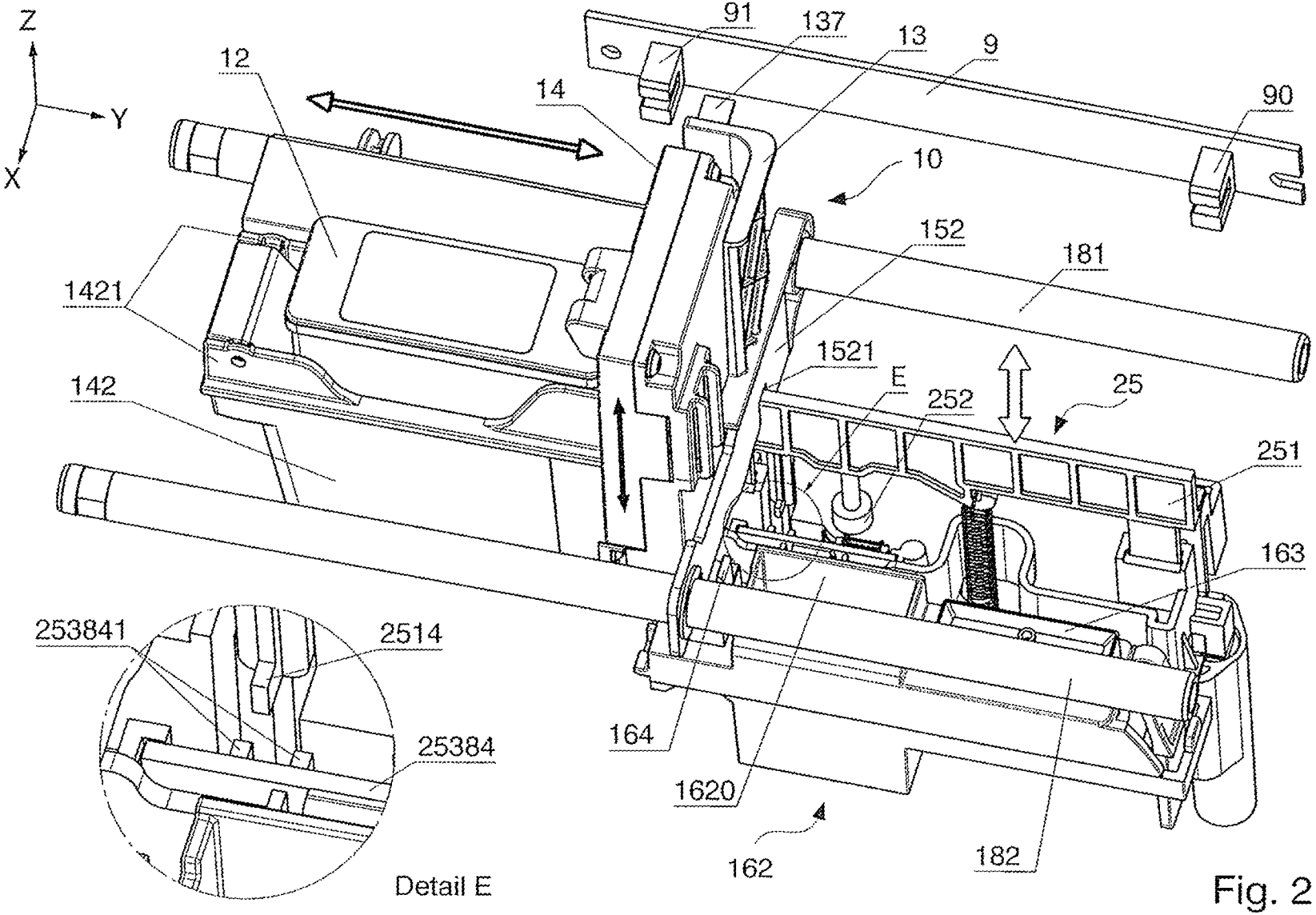
FIG. 2 is a perspective depiction of a printing module in a printing position, with a print carriage and an associated movement mechanism of a processing apparatus according to the invention, downstream from above and behind.

In FIG. 1, the movement states of the inkjet print head of the processing apparatus are explained using a schematic depiction of movement states of a printing module with an inkjet print head in the processing apparatus. The positions of two switching flags relative to the sensors at the different positions of the printing module, and the distances of the positions from one another, are depicted in the example of a franking machine. A sled of the printing module (FIG. 2) may be moved relative to the y-coordinates $y_A$, $y_B$, $y_C$, and $y_D$, and a print carriage of the printing module (FIG. 2) may be moved relative to the coordinates $z_1$, $z_2$, and $z_3$. The positions A and B, C and D of the printing module are shown offset relative to one another counter to the z-direction in order to clarify movement states of the inkjet print head of a processing apparatus. A first nozzle in the array of the inkjet print head used in the printing module actually has a respective constant three-dimensional offset in the x-, y-, and z-direction, but relative to the y-coordinates $y_A$, $y_B$, $y_C$, and $y_D$ of the sled, and relative to the z-coordinates $z_1$, $z_2$, $z_3$ of the print carriage of the printing module (FIG. 2) in all movement states of the printing module (FIG. 2). Therefore, the depicted positions should not be swapped with the actual positions of the inkjet print head that is used.

FIG. 2 shows a perspective depiction of a printing module 10 in the printing position, together with a movement mechanism 25 according to the invention, and with an adapted service module 162 of a new processing apparatus, downstream from the upper rear. In the depiction, "downstream" is situated in the transport direction x of the print medium (not shown), "rear" is situated in the y-direction, and "upper" is situated in the z-direction of a Cartesian coordinate system.

The printing module 10 has a sled 13 that can be moved in the y-direction and counter thereto, meaning transversal to the transport direction x, and a print carriage 14 that can be moved in the z-direction and counter thereto, i.e. that can be vertically displaced, said print carriage 14 having an ink cartridge holder 142 that is equipped with a cavity, bounded by two side walls 1421 in the transport direction x, to accommodate a single 1-inch ink cartridge. The print carriage 14 also includes a control electronics (pen driver board)—not shown—for the 1-inch ink print head of the 1-inch ink cartridge. Via the sled 13 movable transversal to the transport direction x, the printing module 10 may take up various positions, for example the service positions, the printing position, or the exchange position. The service positions comprise a sealing position, a purging position, and a cleaning position. In the sealing position—which is explained in more detail further below using FIG. 1—a single sealing cap 163, arranged stationary, of the single service module 162 is associated with the 1-inch ink print head 12 of the single ink cartridge that is inserted into a receptacle cavity of the print carriage. The service or cleaning or sealing position is not shown in FIG. 2 only for reasons of better clarity. The service module 162 has a wiping lip 164, a purging shaft 1620, and a sealing cap 163. However, in the event of service the latter is not moved onto the ink print head of the ink cartridge—as has previously generally been typical—because a sled at the service module would be necessary for this, but is absent here. The 1-inch ink print head may be raised or lowered onto the sealing cap 163 in the service position (thin-printed fat white arrow with two points) by means of a movement mechanism 25. Attached to the sled 13 is a switching flag 137 that interacts with two forked light barriers 90, 91 if the sled 13 is moved past said forked light barriers 90, 91, transversal to the transport direction x of the print medium. The two forked light barriers 90, 91 are arranged at a distance c+d parallel to the y-direction on a circuit board 9 that is attached to a chassis of the processing apparatus. The switching flag 137 is flat and has a width of approximately 3-8 mm, preferably 6.25 mm, and is attached to the sled 13 of the printing module 10. The sled 13 is supported so as to glide on two guide rods 181, 182 so that the printing module may be moved in the y-direction from the depicted printing position into the service position, and vice versa (thick-printed thin white arrow with two points. An arm 152 of an angle plate is provided at the sled 13 for guidance on the guide rod 182, wherein the arm 152 has a recess 1521 for a means of the movement mechanism 25.

The movement mechanism 25 has additional means for motorized movement of the 1-inch inkjet print head in a z-direction of the Cartesian coordinate system and counter thereto, orthogonal to the transport direction x of the print medium (black arrow with two points), wherein the aforementioned means are arranged so as to be movable vertically (thin-printed fat white arrow with two points). The print carriage 14 of the printing module 10 may be moved vertically, and therein parallel to the z-direction, by means of the movement mechanism 25. At the sled 13, guidance elements are provided for guiding the ink cartridge mount of the print carriage 14 during the raising and lowering of the 1-inch inkjet print head. A lifting bar 251 is a component of the movement mechanism 25 for raising and lowering of the print carriage with the 1-inch inkjet print head, which is designed such that it at the same time enables a movement of the sled 13 transversal to the transport direction x. Likewise molded on the lifting bar 251 is a switching flag 2514 that interacts with a forked light barrier 253841 if the print carriage 14 of the printing module 10 is moved vertically by the movement mechanism 25, and thus parallel to the z-direction by the movement mechanism 25. This arrangement was depicted enlarged in a detail E. The switching flag 2514 is flat and has a width of approximately 2-5 mm, preferably 3.00 mm.

A linear stepper motor 252 is preferably provided as a drive motor of the means which execute the vertical movement.

Respectively shown in one block (drawn with dashed lines) of the schematic depiction of FIG. 1 are sensors of the processing apparatus as a principle image, wherein two of the sensors LSy90 and LSy91 are provided to detect a position during a movement of a sled 13 (see FIG. 2) parallel to the y-direction, in order to therewith be able to determine the precise y-coordinate of the positions B and D of the sled 13. While the positions A, B and D are what are known as stop positions, the position C is what is known as a pass-over position. The marked position F is what is known as an emergency position.

The sensors are executed as forked light barriers 90, 91, and attached to the sled is a switching flag 137 that interacts with the forked light barriers. However, this should not mean that other sensors might not also be alternatively used.

Figure 3:
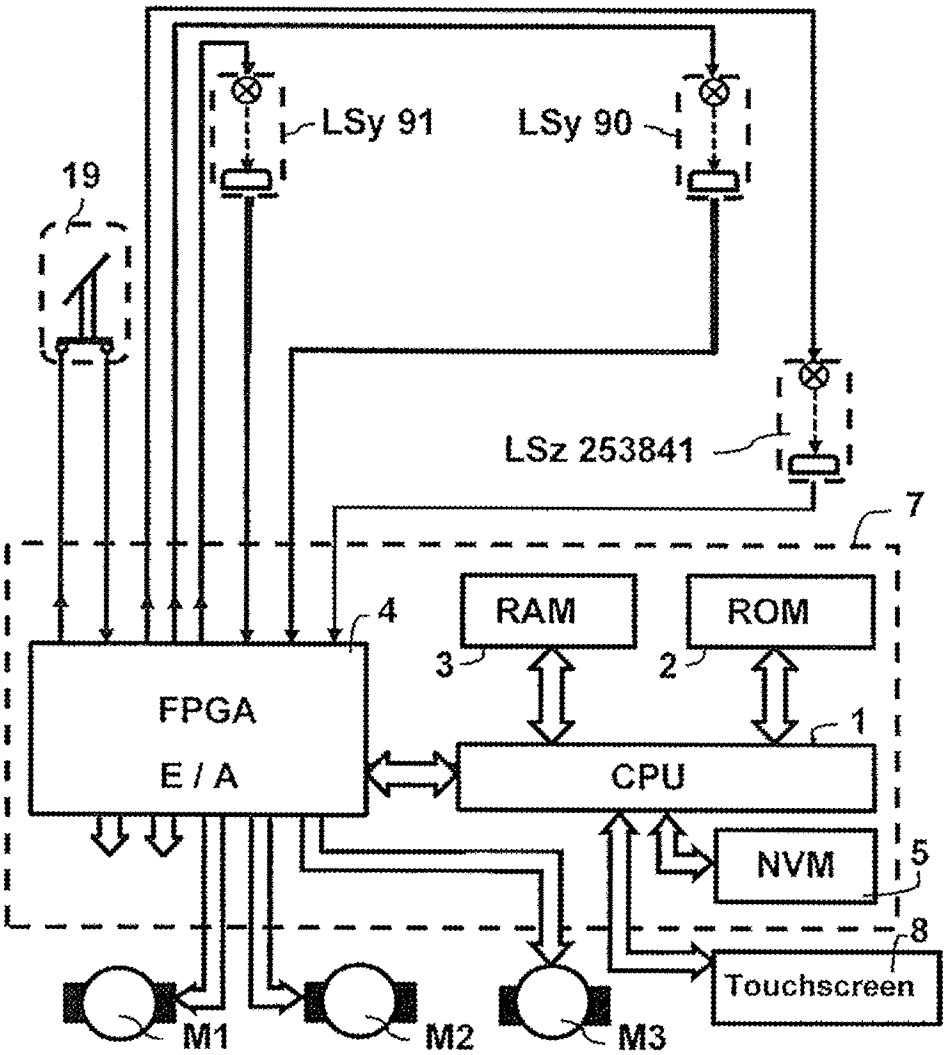
FIG. 3 is a block diagram with a control processor of the mainboard and additional components of the processing apparatus for implementing the activation method according to the invention.

If the sled were to strike a front position F with the coordinates y=0 and z=z1, this is then situated closest to the front side of the processing apparatus, and in a position D this is situated furthest from the front side of the processing apparatus. In a position A with coordinates y=yA=a, the sled is offset by a distance a in the y-direction from the front position F, and the switching flag 137 has arrived in a state 137Ay. In a position B with the coordinates $y=y_B=a+b$, the sled has been moved in the y-direction from the position A, starting from a distance b etc. In the state 137Ay, the switching flag 137 is depicted as a white rectangle; in the state 137By, the switching flag 137 is depicted as a rectangle shaded at an angle; in the state 137Cy, the switching flag 137 is depicted as a rectangle with a small-diamond pattern; and in the state 137Dy, the switching flag 137 is depicted as a rectangle with a brick wall pattern. All positions A, B, C, D are in distance order in the y-direction from the Not-position F. The position A is at a distance of 2 mm<a<5 mm from the Not-position F. The position B is at a distance of 15 mm<b<16 mm from position A. The position C is at a distance of 71 mm<c<75 mm from position B, and position D is at a distance of 43 mm<d<45 mm from position C. The distance b is, for example, only approximately one-third of the distance d, and approximately one-fifth of the distance c. The processing apparatus may be realized as a franking machine in which, for example, the light beams of the forked light barriers are arranged at a distance (c+d)=115.6 mm from one another on a frame (not shown) of the chassis, and are situated parallel to one another. The distance b is preferably 14.625 mm, and the distance a=3 mm. The sled is preferably driven by a stepper motor (not shown) that is activated by a control processor 7 (FIG. 3). The sensors are operationally connected with the control processor 7 of the processing apparatus in order to detect an interruption of a light beam L of a photoelectric barrier by the switching flag 137 of the sled 13 during the movement of said sled parallel to the y-direction. The function of the photoelectric barrier is explained using the forked light barrier 91. A light-emitting diode LED emits a light beam L that is received by a corresponding light receiver R, for example a phototransistor, as long as the light beam L is not interrupted. Given an interruption by the switching flag 137 in the state 137By, the signal (H level) is interrupted and drops to an L level. The sled with the switching flag 137, said sled being driven by a drive motor M2 (FIG. 3), preferably a stepper motor, will move still further by a defined number of steps in the same direction (white arrow) so that a negative edge of the signal forms with certainty. A leading edge of the switching flag in the state 137By is preferably A=1 mm distant from the light beam L if a halt point of the sled at the position B is reached. The position B corresponding to the printing position in a franking machine, for example. To reach the position A, for example, the print carriage must be vertically by a height h1=10 mm from a second x/y-plane at the coordinate z=z2 up to a first x/y-plane at the coordinate z=z1, whereas it is moved counter to the y-direction (white arrow). In the state 137Ay, a trailing edge of the switching flag is preferably at a distance of e=11.5 mm from the light beam L of the photoelectric barrier LSy91 if a halt point of the sled at the position A is reached. In a franking machine, position A corresponds to an ink cartridge exchange position. In a franking machine, position C corresponds to a service position or cleaning position.

What is also meant by a movement of the sled parallel to the y-direction is a movement counter to the y-direction. The sled is first moved in the y-direction and then counter to the y-direction for cleaning of the nozzles of the inkjet print head, which movement should be clarified by means of two white arrows using the switching flag in the state 137Cy. The sled with the switching flag 137 is again moved further by a defined number of steps in the same direction (white arrow) so that a negative edge of the signal forms with certainty. Given a movement in the y-direction, a halt point is already reached if the trailing edge of the switching flag is at a distance of g=40.485 mm from the position D. On the one hand, this halt point is a reversal point for the sled movement direction. On the other hand, given a movement counter to the y-direction, an additional halt point is only reached if the leading edge of the switching flag is at a distance of f=68.865 mm from position B. This halt point is normally likewise a reversal point for the sled movement direction; given a wiping for cleaning of the nozzles of the inkjet print head with a wiping lip, the inkjet print head is moved back and forth between the halt points B and C. The two halt points are therefore also referred to as reversal points. Given a further movement in the y-direction, a next following additional halt point is only reached when the trailing edge of the switching flag is at a distance of o=1.25 mm from position D. In the state 137Dy, the switching flag is marked as a rectangle with brick wall pattern. Given a PostBase-type franking machine, for example, the distance c=71.99 mm between positions B and C and distance d=43.61 between positions C and D.

A height-adjustable print carriage 14 is installed on the sled, wherein the print carriage may be raised or lowered, parallel to the z-direction, by a movement mechanism 25 (see FIG. 2). An additional sensor LSz, which is advantageously executed as a forked light barrier 253841 and installed on a circuit board 25384 (detail E of FIG. 2), is provided to detect this vertical movement of the print carriage. The circuit board with the sensor LSz is attached to a static part of the movement mechanism, and a switching flag 2514 (see FIG. 2) is attached to a moving part of the movement mechanism 25. This sensor LSz is also operationally connected with the control processor 7 (FIG. 3) of the processing apparatus in order to detect an interruption of a light beam of a photoelectric barrier by the switching flag 2514 of the moving part of the movement mechanism 25 during the movement of the print carriage parallel to the z-direction. The moving part of the movement mechanism 25 is driven by a further drive motor M2 (see FIG. 3), which is likewise activated by the control processor 7. Given a further movement in the y-direction from position C (service position) into position D (sealed position), the print head may be lowered with high precision and also deeper at the service station.

Via a suitable activation method, an inkjet print head may thus be moved to different positions within a y/z-plane. An ink cartridge exchange position A at the beginning of a movement path is at a distance in the y-direction from the front position F, and at the same time is at a highest (as viewed in the z-direction) first x/y-plane. A printing position B is at a distance b from the position A on the movement path in the y-direction, and at the same time is at a lower second x/y-plane that is reached after a movement path counter to the z-direction. The first x/y-plane is at a height h1=10 mm in the z-direction above the second x/y-plane, wherein at least the printing position B is situated in the latter.

A cleaning position C is situated at a distance c from the printing position B on the movement path in the y-direction, and either simultaneously—as at the printing position B—at a second x/y-plane or at an additional x/y-plane (not shown) that is situated below the second x/y-plane. The first x/y-plane is situated at a distance of h3=12.95 mm in the z-direction above a fourth x/y-plane in which the position D is provided (see FIG. 1*a*). The position D is also referred to in the following as a sealing position. The sensor LSz detects the achieved position given a vertical movement of the moving part of the movement mechanism 25. However, the vertical movement has not yet stopped at the point in time at which the sensor LSz is switched, so that an edge of the signal forms with certainty. If a print carriage has been moved with the sled into the first position A (exchange position) and is situated at the highest first x/y-plane in the z-direction, then it has been raised in the z-direction by the means 21 relative to the low, second x/y-plane. If the middle of a switching flag 2514 of the means 251 is situated at the highest first x/y-plane in the z-direction, then a lower edge of the switching flag 2514 is situated at a distance of h2=8.5 mm from the low second x/y-plane, wherein position B is located at the second x/y-plane, parallel to the z-direction. In this position 2514Az1, the switching flag 2514 is marked as a rectangle with checkerboard pattern. If the means 251 is now moved out of this position, counter to the z-direction, into the low second x/z-plane, the light beam of the photoelectric barrier LSz is interrupted before the switching flag 2514 arrives in a position 2514Bz2. In this position, the switching flag 2514 is marked as a rectangle with a dot pattern. The top edge and bottom edge of the switching flag 2514 are symmetrically situated, meaning that they are respectively at a distance of k1=k2=1.5 mm from the second x/y-plane. The print carriage may be moved from this position 2514Bz2 into a lower-situated third x/y-plane. In the position D, the top edge of the switching flag 2514 is at a distance of k3=1.5 mm in the z-direction from the third x/y-plane, or at a distance of h4=1.45 mm from the second x/y-plane. At this position D, in the state 2514Bz3 the switching flag 2514 is represented as a rectangle with a wave pattern.

FIG. 3 is a block diagram with a control unit of the mainboard, sensors, and actuators, as well as further means of the processing apparatus for implementing the activation method. A processor circuit 1 of a control processor 7 of the processing apparatus is operationally connected at least with a read-only memory (ROM) 2 as a fixed value storage; a working memory (RAM) 3; a non-volatile memory (NVM) 5; with an input/output circuit 4; and a user interface (touchscreen) 8. Drive motors are used as actuators. The input/output circuit 4 may be designed as a field programmable gate array (FPGA).

The input/output circuit 4 is electrically connected on one side with the sensors of the processing apparatus in order to receive sensor signals, and on the other side in terms of control with a first drive motor M1, with a second drive motor M2, and with a third drive motor M3. The first drive motor M1 is provided so as to execute a predetermined vertical movement if the drive motor M2 is activated accordingly. The second drive motor M2 causes a movement of the sled parallel to the y-direction. The third drive motor M3 serves to drive a transport module (not shown) for the transport of a print medium that is supplied to the printing module for purposes of printing. The sensors of the processing apparatus include a probe 19, the two sensors LSy90 and LSy91 for a movement of the sled parallel to the y-direction, and the sensor LSz for a movement of the print carriage parallel to the z-direction. The probe 19 should detect an opening of a flap that must be opened before an exchange of a cartridge. The sensor LSz is marked with the reference character 253841 (FIG. 2, Detail E). The first drive motor M1 is, for example, a linear stepper motor 252 whose axis is coupled with the means 251 (FIG. 2) in order to be able to execute a predetermined vertical movement of the print carriage 14 (FIG. 2). The print carriage 14 can be moved in the z-direction and counter thereto and travels a distance of 0.254 mm per full step vertically in the z-direction and counter thereto (FIG. 2).

The second drive motor M2 is, for example, a stepper motor which acts via a threaded spindle on a screw nut of the sled (in a known manner) in order to enable a displacement of the position of the sled parallel to the y-direction. The sled 13 can be moved in the y-direction and counter thereto.

Figure 4:
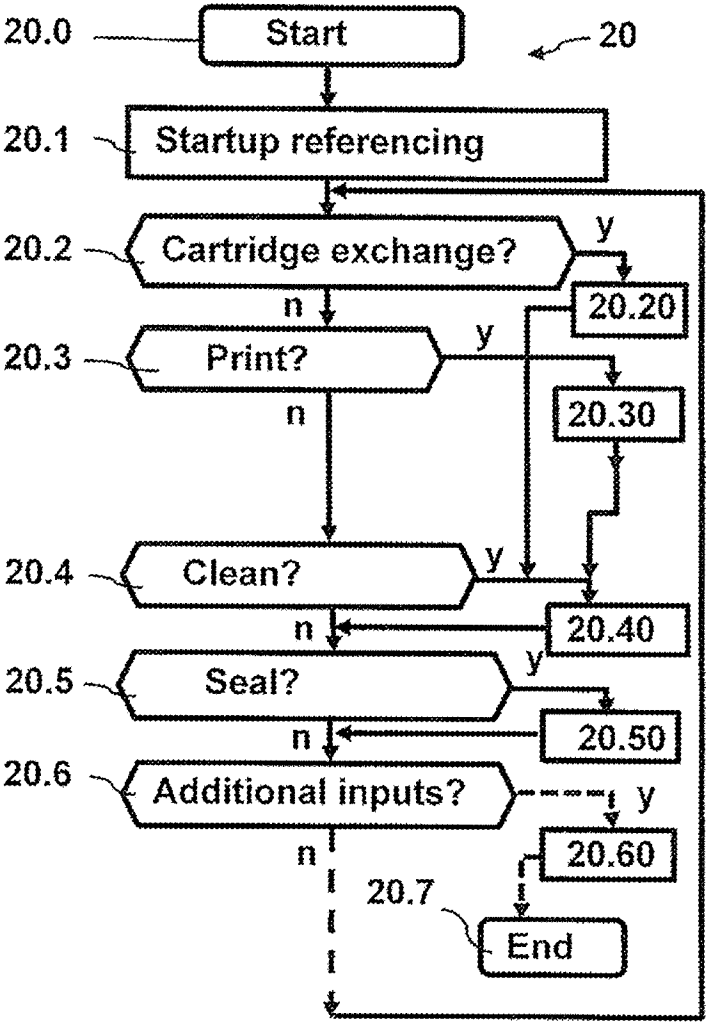
FIG. 4 is a program workflow for selection of an activation method according to the invention as a principle image.

A flowchart 20 for selection of an activation method is presented as a principle image in FIG. 4. After a command to deactivate the printer apparatus, the print carriage is moved into the sealing position D again before power is disconnected. After the start in step 20.0, a startup referencing first takes place in a following step 20.1. Query steps 20.2 through 20.6 are subsequently run through in order to enable a selection of an activation method for different actions, wherein—with the exception of the selection of a printing—the selected respective activation method 20.20 to 20.60 is started immediately after the startup referencing is started, and the inkjet print head is thereby moved out of the sealing position D. After selection 20.3 of a printing, a program 20.30 is first automatically called to activate the printing position, and directly following this a program 20.40 is automatically called for activating the cleaning or service position of an inkjet print head, and only afterward may a program control a printing if the inkjet print head has been moved back into the printing position at the end of the program 20.40. After activation of a position, the following query step is respectively called, except after the program 20.20 for cartridge exchange, because movement into the position B cannot yet take place after the movement into the position A; rather, the workflow will first directly jump automatically to the program 20.40 for activation of the cleaning or service position of an inkjet print head before the next following query step 20.5 for selection of a sealing of the inkjet print head is called. After a subsequent step 20.50, a sealing of the inkjet print head takes place. Afterward, optional additional query steps 20.6 and associated programs 20.60 are possible (indicated with dashed lines) before a jump back to the start of step 20.2 for cartridge exchange takes place.

Figure 5:
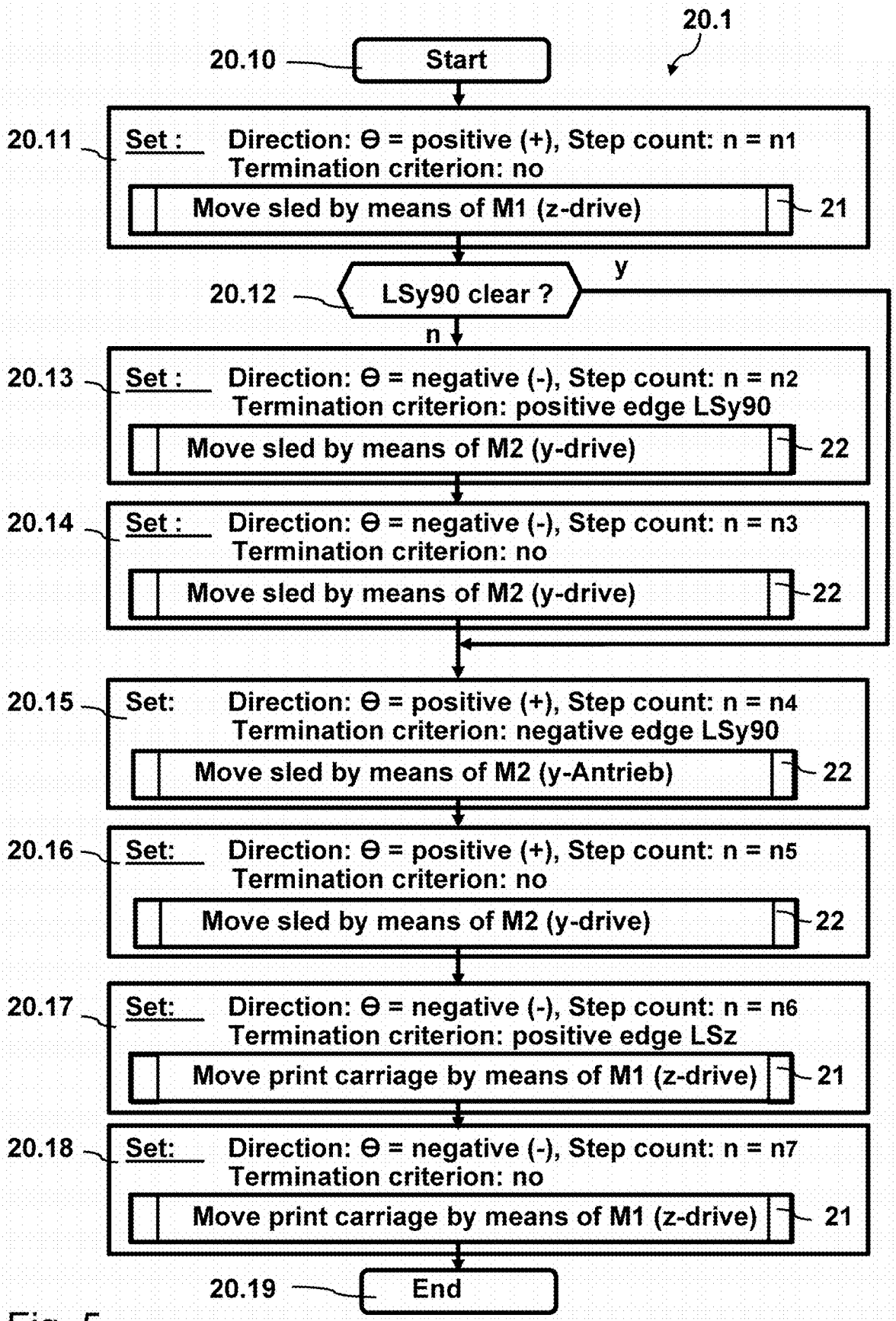
FIG. 5 is a program workflow of an activation reference according to the invention.

The program workflow 20.1 of a startup referencing arises from FIG. 5. After a start in step 20.10 of the startup referencing 20.1, in a step 20.11 parameters are passed to a sub-program 21 (FIG. 6) for vertical movement of the print carriage. In FIG. 5, it is described in detail as an example of a use of a stepper motor as a drive motor M1. A corresponding parameter, such as the step count $n=n_1$ and direction θ, as well as a termination criterion, are passed to the sub-program 21 for program implementation. During a startup referencing, the direction θ=positive, meaning that this points in the z-direction, and the step count for the stepper motor is predetermined with $n=n_1$=maximum in order to arrive from the sealing position into a stop position. The stop position in the z-direction is known, and its coordinates may therefore be stored in a non-volatile manner. The drive motor M1 is thus initially activated by the controller 7 (FIG. 3) in order to move the print carriage vertically in the z-direction until a stop at the highest x/y-plane is reached.

Figure 9:
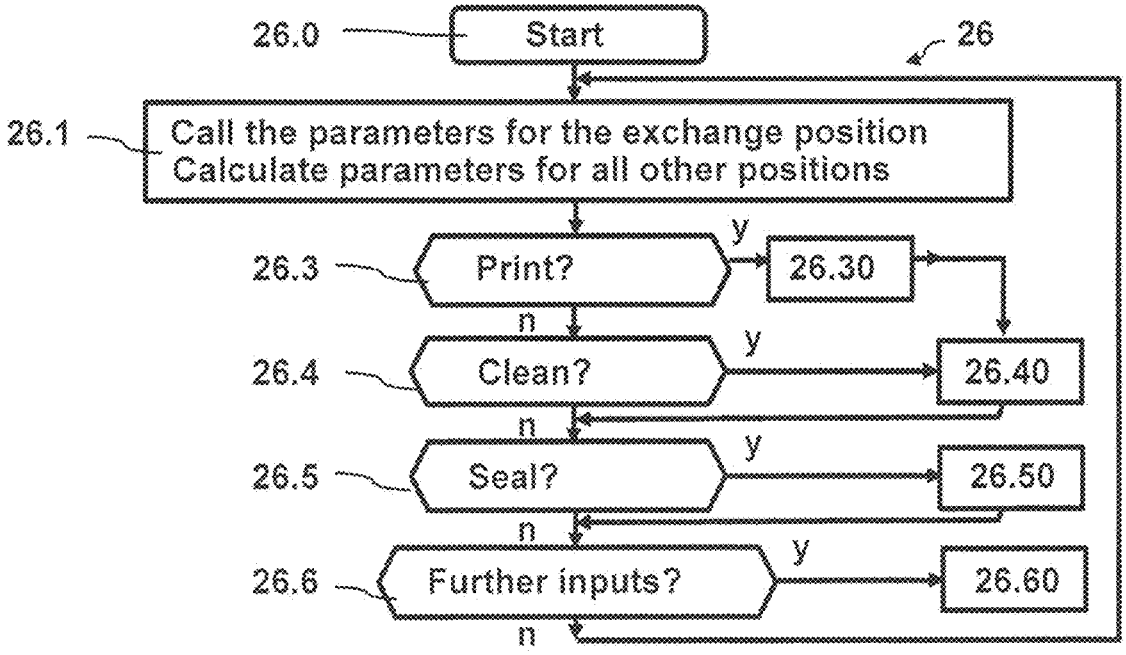
FIG. 9 is a program workflow for movement of the inkjet print head from a cartridge exchange position in one of the other positions according to the invention.

The print carriage may be moved not only out of the sealing position but rather out of every other position up to the aforementioned stop (FIG. 9).

Only one of the two sensors that are arranged along the movement path parallel to the y-direction, for example a photoelectric barrier LSy90, is situated in proximity to the sealing position D. In a query step 20.12 (FIG. 5), the processor 1 of the control processor 7 therefore polls a signal that is emitted by the photoelectric barrier LSy90. If the light beam of the photoelectric barrier LSy90 is interrupted by a switching flag 137 of the sled, the photoelectric barrier LSy90 is not free and the workflow branches to step 20.13. The drive motor M2 is activated by the controller 7 (FIG. 3) in order to move the sled. A stepper motor is preferably likewise used as a drive motor M2. Such parameters, such as step count $n=n_2$ and a movement direction, as well as a termination criterion, are passed as absolute values to a sub-program 22 (FIG. 7) for the horizontal movement of the sled. In step 20.13, the sled with the print carriage is moved horizontally, counter to the y-direction. During the program implementation, the sub-program 22 checks whether the condition of the termination criterion has been satisfied.

In a subsequent step 20.14, a corresponding parameter (set to a different predetermined value) of step count $n=n_3$ and a direction θ are passed to the program implementation. In both steps 20.13, 20.14, the sled is moved in the negative direction, thus counter to the y-direction. The workflow subsequently branches from step 20.14 to step 20.15.

Otherwise, when the light beam of the photoelectric barrier LSy90 is not interrupted by a switching flag 137 of the sled, the photoelectric barrier LSy90 is clear and the workflow branches from the query step 20.12 directly to step 20.15. In step 20.15, the print carriage is moved in the positive y-direction until the condition of the termination criterion is satisfied. For this, sub-programs are called in step 20.15 and in the follow-up step 20.16, wherein in step 20.15 a corresponding parameter (set to a predetermined value) $n=n_4$ and a direction θ as well as a termination criterion and the sub-program 22, in step 20.15 a corresponding parameter (set to a predetermined value) $n=n_5$ and the direction θ=positive are passed to the sub-program 22 for program execution.

In steps 20.13 through 20.16, the sled with the print carriage is thus moved horizontally, counter to the y-direction, and subsequently in the y-direction until a known y-coordinate of the position of the sled has been reached and may be stored. For this, in a step 2202 a respective corresponding parameter (set to a predetermined value), such as the step count n, a direction θ, and if applicable a termination criterion, are passed to a sub-program 22 (FIG. 6) for program implementation.

After running through the sub-programs 21 and 22 in the aforementioned steps 20.11 through 20.16, in step 20.17 a negative direction θ=(−) is established for vertical displacement of the print carriage 14, and a corresponding parameter (set to a predetermined value) $n=n_6$ as well as a termination criterion are passed to the sub-program 21 of the activation method for vertical displacement. While the sub-program 21 is subsequently being run through, as a termination criterion it is checked whether the condition has been met, thus here whether a positive edge has occurred in the signal of the photoelectric barrier LSz.

The sub-program 21 is likewise called in the follow-up step 20.18, wherein a corresponding parameter (set to a predetermined value) $n=n_7$ and the direction θ=negative, but no termination criterion, are passed to the sub-program 21 for program execution. The program 20.1 of the startup referencing therewith ends in the following step 20.19.

Here, the negative direction θ=(−) should mean that the print carriage is moved counter to the z-direction. By contrast, if a positive direction θ=(+) is set, the print carriage is moved in the z-direction, which is not possible at the stop position, however. The direction θ and the magnitude of the displacement upon positioning of the ink print head are dependent on the desired displacement position $y_1$, $z_1$, which should be achieved as a result starting from the current position $y_o$, $z_o$. Thus:

$$\theta=f\{(y_o, z_o)\rightarrow(y_1, z_1)\} \quad (1)$$

As a result of the startup referencing, not only is the sealing position D achieved again, but the achieved position of the 1-inch inkjet print head has been stored in step 20.1 (FIG. 4) as a current y-coordinate of the sled and z-coordinate of the print carriage (the manner is not shown in detail). A wait for input commands 20.2, 20.3, 20.4, 20.5, or 20.6 etc. subsequently occurs, and afterward the program workflow branches to a corresponding further program step/sub-program. A storage of the current position of the print head in non-volatile memory 5 (FIG. 3) takes place (the manner is not shown in detail) at the end of each of the program steps 20.1 for the startup referencing, 20.20 for the cartridge exchange position, 20.30 for the printing position, 20.40 for the cleaning position, and 20.50 for the sealing position, as well as 20.050 in the event of additional inputs.

Figure 6:
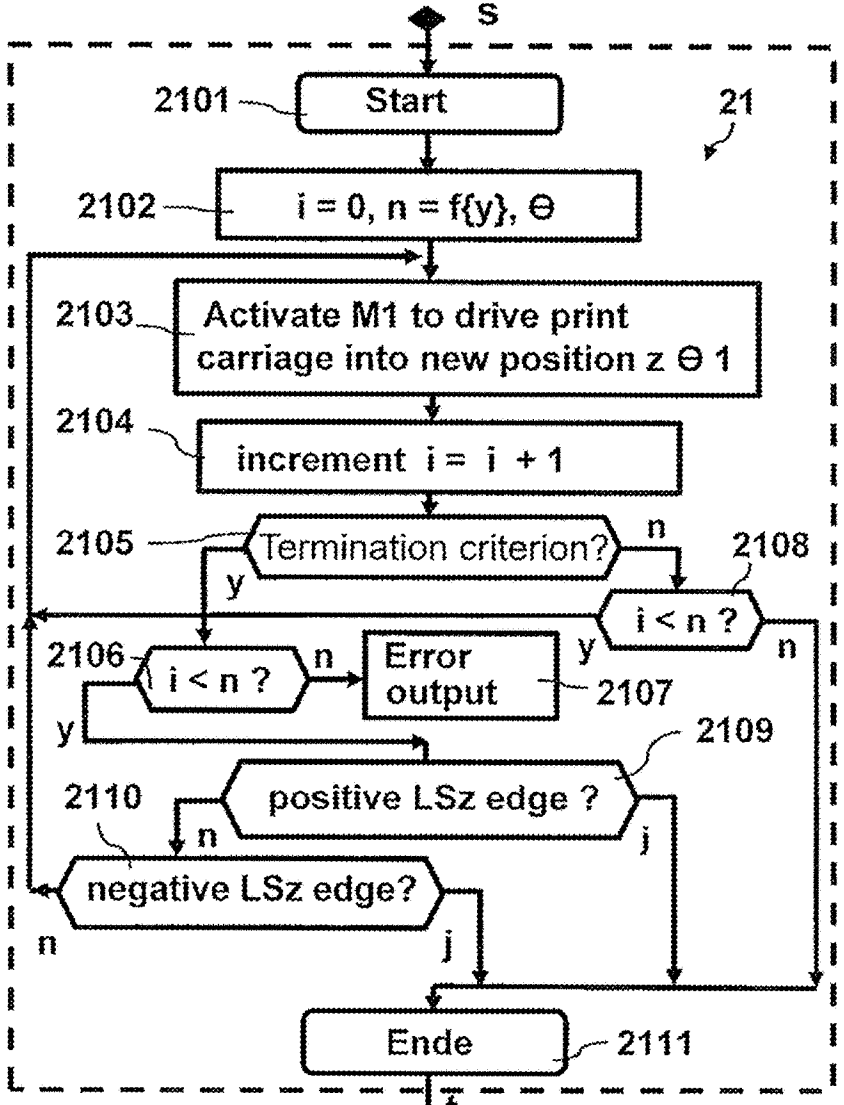
FIG. 6 shows a sub-program of the activation method according to the invention for vertical displacement of the print carriage.

FIG. 6 shows in detail the steps of the sub-program 21 of the activation method for vertical displacement of the print carriage 14. After a start step 2101, the parameters are provided in step 2102. The nominal step count n is set to a maximum step count, corresponding to a magnitude of the displacement of the print carriage parallel to the z-direction, and the movement direction Θ is predetermined and a cycle counter is reset to i=zero. The magnitude of the displacement in the positioning of the print carriage is dependent both on the dimensions of the printing apparatus and of the movement mechanism and on the type of drive motor M1 (FIG. 3) and its activation. In the event that the drive motor M1 is a PL25LMNB-type linear stepper motor 252 (FIG. 2) with a stroke of at least 13 mm, and with full-step activation, the print carriage 14 travels a vertical path of approximately 0.0254 mm per full step. As a nominal step count, n=453 steps is then established to overcome a distance h1+k2=11.5 mm (FIG. 1). The movement direction Θ, for example predetermined in step 20.11 of the program workflow 20.1 of the startup referencing, is positive. However, the movement direction Θ that is predetermined in step 20.18 of the program workflow 20.1 of the startup referencing is negative, thus is predetermined counter to the z-direction. In step 2013, the drive motor M1 is activated by the processor (FIG. 3) in order to move the print carriage one step further in the movement direction Θ parallel to the z-direction, into a new position. For this, a linear stepper motor 252 (FIG. 2) is charged with at least one pulse of a predetermined frequency and a predetermined current.

After step 2103, in step 2104 the loop counter 2105 is incremented by one (i=i+1) by the processor (FIG. 3). After each step, in a query step 2105 a check is made as to whether a termination criterion is present. For example, in step 20.18 of the program workflow 20.1 of the startup referencing (FIG. 5), no termination criterion is present. The workflow consequently branches to the query step 2108. Otherwise, for example in step 20.17 of the program workflow 20.1 of the startup referencing (FIG. 5), a termination criterion is present. In such an instance, according to FIG. 6 the workflow branches from the query step 2105 to a query step 2106 in which a check is made as to whether a maximum step count n according to the termination criterion has been reached. In a step 2107 following the query step 2106, an error output is produced by the processor in the event that, No, the maximum step count has been reached. In the other instance, YES, the step count is below the maximum step count n and an additional query step 2109 is reached. In query step 2109, processor is checked as to whether a positive edge is detected in the LSz signal. A positive edge runs from low to high (LH edge) if an upper edge of the switching flag 2514 clears the light beam of the photoelectric barrier LSz. The upper edge is that edge of the switching flag 2514 that points in the z-direction. An end step 2111 is reached after a positive edge has been detected in the LSz signal. In the other instance, NO, no positive edge is present and a query step 2110 is reached with which a check is made as to whether a negative edge has been detected in the LSz signal. If that is the case, the workflow branches to the end step 2111. If that is not the case, the workflow branches back to the beginning of step 2103. In another instance, in a query step 2108 a check is made as to whether the nominal step count n has been reached. The loop counter has a value i<n in the event that the nominal step count n has not yet been reached. The workflow likewise branches back to the beginning of step 2103 if the loop counter queried in query step 2108 has a value that is less than the nominal step count n. The sub-program 21 situated between two points s and t may be used repeatedly not only program workflow 20.1 of a startup referencing, but rather may also be used repeatedly in other programs.

Figure 7:
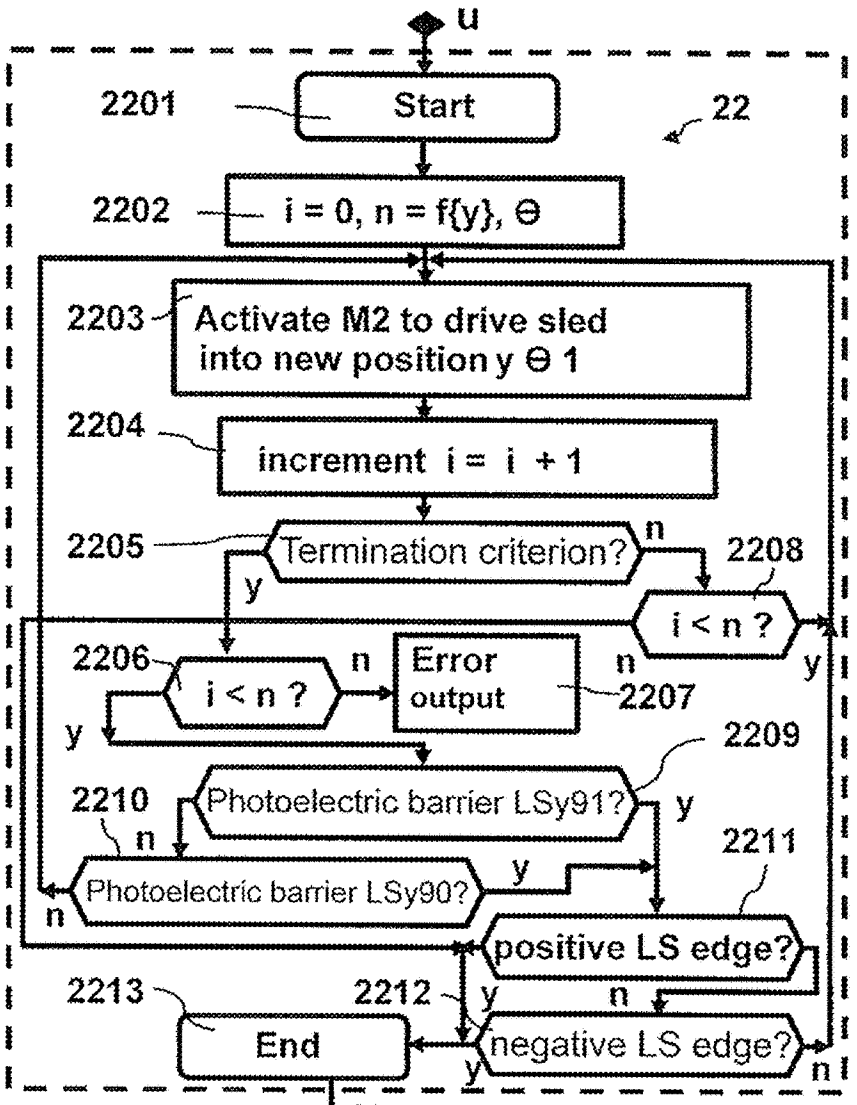
FIG. 7 shows a sub-program of the activation method according to the invention for horizontal displacement of the sled.
Figure 10:
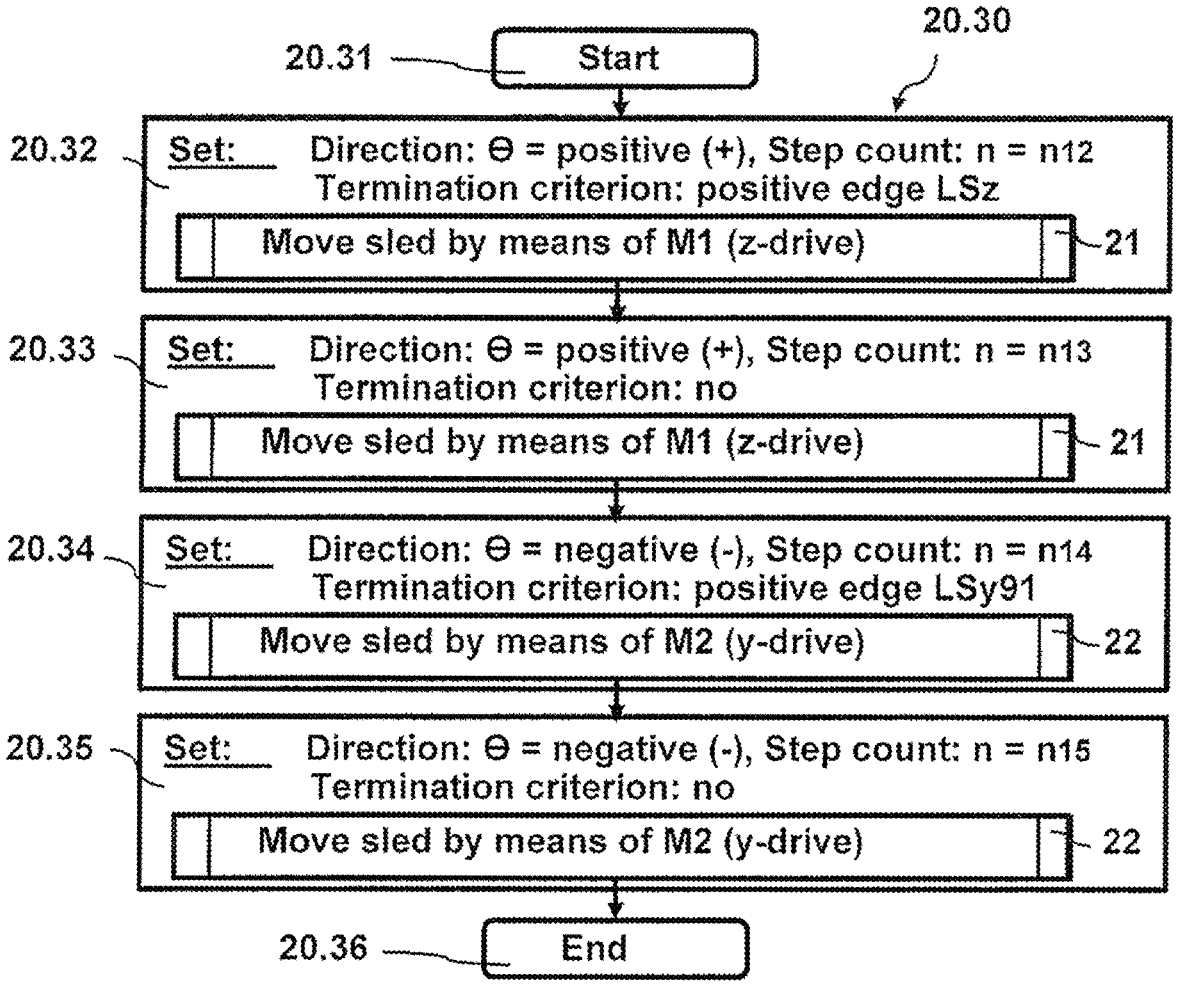
FIG. 10 is a program workflow for movement of the inkjet print head from a sealed position into a printing position according to the invention.

FIG. 7 shows a sub-program 22 of the activation method for horizontal displacement of the sled. The steps 2201 through 2208 of the sub-program 22 are the same as the steps 2101 through 2108 of the sub-program 21, with the sole difference that the drive motor M1 is activated by the processor in step 2103, but in step 2203 the drive motor M2 is activated by the processor (FIG. 3) in order to move the sled a predetermined number of steps further in the same movement direction Θ parallel to the z-direction, into a new position. For example, in step 20.13 of the program workflow 20.1 of the startup referencing (FIG. 5), a termination criterion is present. In such an instance, according to FIG. 7 the workflow branches from the query step 2205 to a query step 2206, in which a check is made as to whether a maximum step count n according to the termination criterion has been reached. In a step 2207 following the query step 2206, an error output is performed by the processor in the event of a NO answer as to whether the maximum step count has been reached. In the other case, YES, the step count is below the maximum step count n and an additional query step 2209 is reached. Given a positive query result in the query step 2206, in a following step 2209 the photoelectric barrier LSy91 is queried, for example as that is required in a program workflow according to FIG. 8 for the movement of the inkjet print head from a sealing position into a cartridge exchange position, which is explained in detail further below. If it results that the query step 2209, meaning photoelectric barrier LSy91 should not be queried, thus in the event of NO, the query step 2210 is then reached. In the query step 2210, a check is made as to whether the photoelectric barrier LSy90 should be queried. In the event of NO, both photoelectric barriers LSy90 and LSy91 should not be queried; rather, the workflow branches back to the beginning of step 2203. In the other case, YES, one of the two photoelectric barriers LSy90 and LSy91 should be queried, as has been explained in steps 20.13 and 20.15 of the program workflow 20.1 of the startup referencing (FIG. 5), or as will be explained in detail further below in steps 20.24 of the program workflow 20.20 (FIG. 8) and 20.34 of the program workflow 20.30 (FIG. 10). In the event of YES, in steps 2211 or 2212 the signal of the photoelectric barrier that is respectively predetermined by the communicated conditions is checked as to whether a positive or negative edge occurs. If that is not the case, the workflow branches back to the beginning of step 2203. Otherwise, the end of the sub-program 22 is reached in step 2213. In another instance, in step 2295 it was established that no termination criterion has been provided, and thus in a query step 2208 a check is made as to whether the nominal step count n has been reached. The loop counter has a value i<n in the event that the nominal step count n has not yet been reached. Consequently, the workflow branches back to the beginning of step 2203. In the event of NO, the condition i<n does not apply, however, and step 2213 is reached, and thus the end of the sub-program 22.

The sub-program 22 situated between points u and v may not only be used repeatedly in the program workflow 20.1 of a startup referencing, but rather also may be used repeatedly in other programs.

Figure 8:
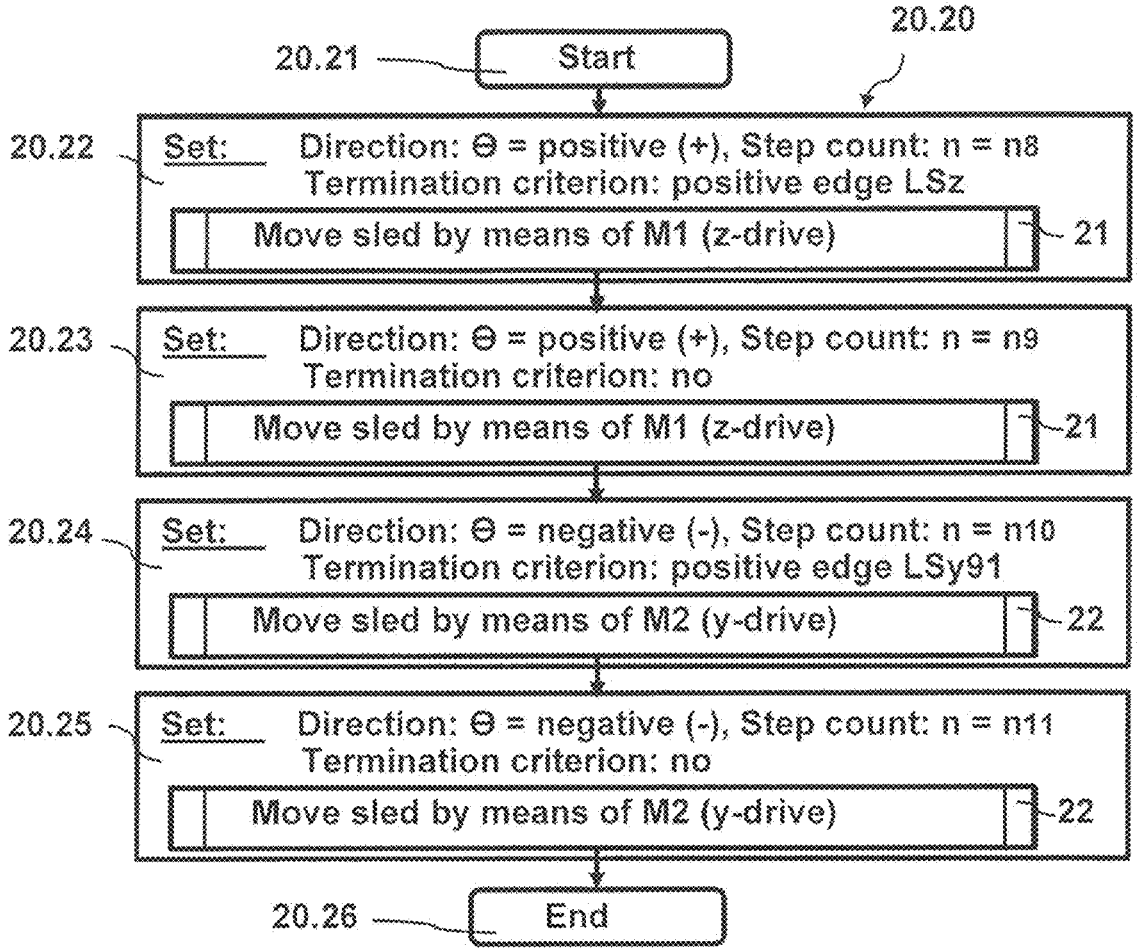
FIG. 8 is a program workflow for movement of the inkjet print head from a sealed position into a cartridge exchange position according to the invention.

Depicted in FIG. 8 is a program workflow 20.20 for movement of the inkjet print head from a sealing position into a cartridge exchange position. After a start step 20.21, a step 20.22 is reached. In step 20.22, the parameters step count $n=n_8$, direction Θ=positive, and as a termination criterion the condition of the occurrence of a positive edge of the photoelectric barrier LSz are predetermined, and the sub-program 21 is implemented. During the implementation of the sub-program 21, the drive motor M1 is activated by the processor (FIG. 3) in order to move the print carriage further by a predetermined number of n8 steps in the positive movement direction Θ parallel to the z-direction, into a new position. Afterward, a step 20.23 is reached. In step 20.23, the parameters step count $n=n_9$ and direction Θ=positive are provided, and the sub-program 21 is implemented. During the implementation of the sub-program 21, the drive motor M1 is activated by the processor (FIG. 3) in order to move the print carriage further by a predetermined number of $n_9$ steps in the positive movement direction Θ parallel to the z-direction, into a new position. Afterward, a step 20.24 is reached. In step 20.24, the parameters of step count $n=n_{10}$, direction Θ=negative, and as a termination criterion the condition of the occurrence of a positive edge of the photoelectric barrier LSy91 are provided, and the sub-program 22 is implemented. During the implementation of the sub-program 22, the drive motor M2 is activated by the processor (FIG. 3) in order to move the print carriage further by a predetermined number of $n_{10}$ steps in the negative movement direction Θ parallel to the y-direction, into a new position. Afterward, a step 20.25 is reached. In step 20.25, the parameters of step count $n=n_{11}$, direction Θ=negative are provided, and the sub-program 22 is implemented. During the implementation of the sub-program 22, the drive motor M2 is activated by the processor (FIG. 3) in order to move the print carriage further by a predetermined number of $n_{11}$ steps in the negative movement direction Θ parallel to the y-direction, into a new position. Afterward, an end of the program is reached in step 20.26.

FIG. 9 shows a program workflow 26 for movement of the inkjet print head from a cartridge exchange position into one of the other positions. In contrast to program 20 (FIG. 4), the respective starting positions are different. A startup referencing is not necessary here. In the program workflow 26, after a start step 26.0 a step 26.1 is reached in order to enable a calling of the parameters n for the exchange position and a calling or calculation of the parameters n for all other positions, wherein the parameters n are present if, in the following query steps 26.3, 26.4, 26.5, and 26.6, a selection is now made as to whether a printing, cleaning, sealing, or additional actions should take place. In the event of a YES result to the query, a selection takes place in a query step; but, in the event of a NO result, no selection takes place in the query step, and the workflow branches to the next subsequent query step. Given a selection of the printing in query step 26.3, the workflow initially automatically branches to a step 26.40 for movement of the inkjet print head from the exchange position into a printing position. A step 26.30 is subsequently automatically reached for the movement of the inkjet print head from the printing position into the cleaning position and back. Given a selection of the cleaning in query step 26.4, a step 26.40 is reached for movement of the inkjet print head from the exchange position into the cleaning position. Given a selection of the cleaning in query step 26.5, a step 26.50 is reached for the movement of the inkjet print head from the exchange position into the sealing position. Given a selection of an additional input in the query step 26.6, a step 26.60 is reached for implementation of the selected action. Given a NO, the workflow branches from the query step back to the beginning of step 26.1.

FIG. 10 shows a program workflow 20.30 for movement of the inkjet print head from a sealing position into a printing position. After the start in step 20.31, a step 20.32 is reached. In step 20.32, the parameters of step count $n=n_{12}$, direction Θ=positive, and as a termination criterion the condition of the occurrence of a positive edge of the photoelectric barrier LSz are provided, and the sub-program 21 is implemented. This step 20.32 differs from step 20.22 according to FIG. 8 merely in the parameter of step count $n=n_{12}$ instead of $n=n_8$. During the implementation of the sub-program 21, the drive motor M1 is activated by the processor (FIG. 3) in order to move the print carriage further by a predetermined number of $n_{12}$ steps in the positive movement direction Θ, parallel to the z-direction, into a new position. Afterward, a step 20.33 is reached. In step 20.33, the parameters of step count $n=n_{13}$, direction Θ=positive are provided, and the sub-program 21 is implemented. The difference relative to the previous step and the equivalent step 20.23 according to FIG. 8 exists merely in the parameter of step count $n=n_{13}$. The sum of the step counts $n_{12}+n_{13}$ correspond to a height h3 (FIG. 1) to be surmounted in the positioning of the print carriage parallel to the z-direction. The subsequent steps 20.34, 20.35 according to FIG. 10 are equivalent to steps 20.24, 20.25 according to FIG. 8, and differ only in the parameters of step counts $n=n_{14}$ and $n=n_{15}$. In both steps, the drive motor M2 is activated by the processor (FIG. 3) in order to move the print carriage further by a predetermined number of steps in the same, here negative movement direction Θ, parallel to the y-direction, into a new position. The step counts n correspond to the distance in order to move the sled with the inkjet print head of the print carriage horizontally further counter to the y-direction, for example out of a sealing position D during the activation of a printing position B. The sum of the step counts $n_{14}+n_{15}$ corresponds to the sum of the total distance A+c+d (FIG. 1) in the positioning of the sled parallel to the y-direction. An end of the program is subsequently reached in step 20.36.

Figure 11:
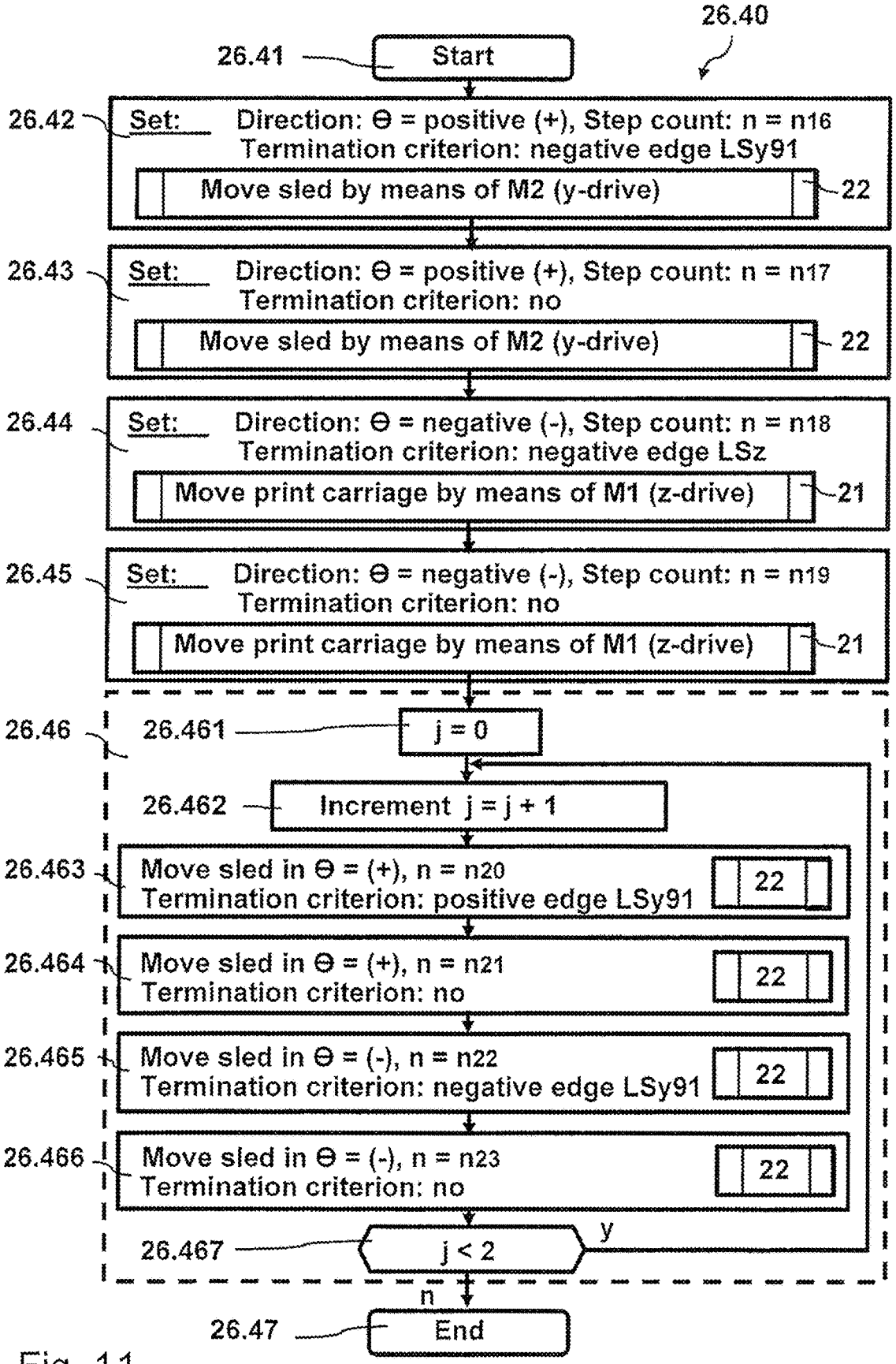
FIG. 11 is a program workflow for movement of the inkjet print head from a cartridge exchange position into a printing position, with an immediately following movement into a cleaning position, followed by a cleaning operation, and return into the printing position, according to the invention.

FIG. 11 shows a program workflow for movement of the inkjet print head from a cartridge exchange position into a printing position, with an immediate subsequent movement into a cleaning position, a cleaning, and return into the printing position. After a start step 26.41, in the following step 20.42 a positive movement direction Θ, a nominal step count $n=n_{16}$ corresponding to a magnitude for the displacement of the sled 13 in the y-direction, and an occurrence of negative edge in the signal of the sensor LSy91 as a termination criterion for the sub-program 22 are provided. In the sub-program 22 (FIG. 7), after the start step 2201 a step 2202 is reached in which the nominal step count n, corresponding to a magnitude for displacement of the sled 13 in the y-direction, and a positive movement direction Θ are provided and a loop counter is reset to i=zero. The magnitude of the displacement in the positioning of the sled 13 is dependent both on the dimensions of the printing apparatus and of the movement mechanism, and on the type of drive motor M2 (FIG. 3) and its activation. The magnitude which is required given changing of the positions may be calculated. After the end of the sub-program 22 (FIG. 7) in step 20.42, the trailing edge of the switching flag 137 has already interrupted the light beam. In the following step 20.43, a positive movement direction Θ and a nominal step count of $n=n_{17}$ are provided, but not a termination criterion for the sub-program 22, which is called repeatedly. In step 20.43, the sled is consequently moved a distance further in the same positive movement direction Θ before the inkjet print head arrives at a position vertically above the printing position. In this state 137By, the leading edge of the switching flag 137 has reached a distance Δ relative to the y-coordinate $y_B$ according to FIG. 1. A step 20.44 is now reached in which a negative movement direction Θ, a nominal step count $n=n_{18}$, and an occurrence of a negative edge in the sign of the sensor LSz is communicated as a termination criterion for the sub-program 21. The parameters are passed from the processor (FIG. 3) to the drive motor M1 (FIG. 3) in order to drive the print carriage down from the first x/y-plane to the second x/y-plane. The processor (FIG. 3) ends the sub-program 21 if an occurrence of a negative edge in the signal of the sensor LSz is established. After step 20.44, the step 20.45 is reached and the print carriage is moved further by a distance in the same negative movement direction Θ before the inkjet print head has arrived in the printing position. For this purpose, in step 20.45 the negative movement direction Θ and a nominal step count $n=n_{19}$ is provided again, but not a termination criterion for the sub-program 21, and these are passed to the sub-program 21. After step 20.45, a step 20.46 is reached in which the sled is moved back and forth between two positions B and C in order to clean the nozzles of the inkjet print head by means of a wiper blade of the service station. In step 20.46, a number of sub-steps are executed. In a first sub-step 20.461, a second loop counter is reset to j=zero. In a subsequent second sub-step 20.462, the loop counter is incremented by one. Then, a third sub-step 20.463 is reached in which a positive movement direction Θ, a nominal step count $n=n_{20}$, and an occurrence of a positive edge in the signal of the sensor LSy91 as a termination criterion for the sub-program 22 are provided. The parameters are passed by the processor (FIG. 3) to the sub-program 22 for the drive motor M2 (FIG. 3) in order to move the sled in the y-direction until the photoelectric barrier LSy91 is cleared. In the fourth sub-step 20.464, a positive movement direction Θ and a nominal step count $n=n_{21}$ are provided, but not a termination criterion for the sub-program, and these are passed to the sub-program 22 for the drive motor M2 (FIG. 3) in order to move the sled in the y-direction by a distance of 68.86 mm, up to the y-coordinate $y_C$. Afterward, a fifth sub-step 20.465 is reached in which a negative movement direction Θ, a nominal step count $n=n_{22}$, and an occurrence of a negative edge in the signal of the sensor LSy91 as a termination criterion are provided to the sub-program 22. The parameters are passed by from the processor (FIG. 3) to the sub-program 22 for the drive motor M2 (FIG. 3) in order to move the sled counter to the y-direction until the photoelectric barrier LSy91 is triggered. After the fifth sub-step 20.465, a sixth sub-step 20.466 is reached in which the sled is moved further in the same direction until the state 137By according to FIG. 1 is reached again, in which the leading edge of the switching flag 137 has a distance A from the y-coordinate $y_B$. In a query step 20.467, a query is made as to whether the loop counter has a count value of j<2. In the positive case YES, the workflow branches back to the beginning of the second sub-step 20.462. In the other case, NO, the step 20.46 is ended. After the step 20.46, the inkjet print head is again standing in the printing position and an end step 20.47 is reached.

In the aforementioned exemplary embodiment, the processing apparatus is realized as a franking machine, the drive motors are stepper motors, and the parameters for their activation are the step count of steps of the respective stepper motor, in the movement direction. However, the movement velocity may be provided as another parameter. Other realization possibilities should also not be precluded. Given the use of servo motors as the drive motors, additional sensors are required for a precise setting of the positions of the printing module. Naturally, the sub-programs for vertical displacement must be adapted to the number of required sensors in that additional termination criteria are considered.

Although, in the aforementioned exemplary embodiment according to FIG. 11, the printing position is driven to first and then the inkjet print head is then cleaned, and afterward the inkjet print head is driven back into the printing position, alternatively the cleaning position may also be driven to first and only then is the printing position driven to.

Although only an embodiment for three x/y-planes was explained in detail using FIG. 1, additional x/y-planes for additional positions of the printing module are not excluded. An intermediate plane may easily be inserted between the x/y-planes that have been depicted in FIG. 1, and alternative program variants may be achieved, for example in order to further improve the servicing in that the coverage of the wiping lip with the nozzles of the nozzle plate is varied. In all of these program variants, sub-programs are required that enable a vertical movement of the inkjet print head.

The additional generation of a vertical movement of the inkjet print head may also be provided during the movement of the inkjet print head from an exchange position or sealing position into at least one other position, in particular printing position or cleaning position.

Although modifications and changes may be suggested by those skilled in the art, it is the intention of the Applicant to embody within the patent warranted hereon all changes and modifications as reasonably and properly come within the scope of the Applicant's contribution to the art.

The invention claimed is:

1. An activation method for operating a processing apparatus that processes individual items, said processing apparatus comprising an inkjet print head, said activation method comprising:

from a control processor, providing control signals to a drive motor arrangement in order to operate a transport mechanism to transport individual items in the x-direction of a Cartesian coordinate system past said inkjet print head in a printing position so as to execute a printing operation with said inkjet print head on each individual item;

from said control processor, providing said control signals to said drive motor arrangement so as to move said inkjet print head in the y-direction of the Cartesian coordinate system into a first position selected from the group consisting of an exchange position at which an exchange operation is implemented to exchange an ink cartridge for said inkjet print head, said printing position, a cleaning position in order to implement a cleaning operation of said inkjet print head, and a sealing position in order to seal said inkjet print head; and from said control processor, providing said control signals to said drive motor arrangement to also move said inkjet print head vertically, in the z-direction of said Cartesian coordinate system from said exchange position or said sealing position, into at least one second position selected from the group consisting of said printing position and said cleaning position.

2. An activation method as claimed in claim 1 comprising, in said control processor, generating said control signals by executing a program that comprises a sub-program that generates control signals for displacing a print carriage of a printing module that comprises said inkjet print head, in order to vertically move said inkjet print head in said z-direction.

3. An activation method as claimed in claim 2 comprising repeatedly calling said sub-program in said control processor in order to repeatedly vertically move said inkjet print head in said z-direction.

4. An activation method as claimed in claim 2 comprising, in said program, designating said exchange position or said sealing position as a starting position, and executing said program so as to implement startup referencing at a point in time of startup of said processing apparatus, before movement of said inkjet print head into said starting position, when position information is not present in a memory accessible by said control processor, and moving said inkjet print head to a different position from said starting position only when a position of the inkjet print head at said point in time of startup is known to said control processor.

5. An activation method as claimed in claim 2 comprising also in said program executed by said control processor, executing a further sub-program for moving said inkjet print head in said y-direction, and repeatedly calling said further sub-program for startup referencing.

6. An activation method as claimed in claim 2 comprising accessing movement data for said sub-program from a memory, said movement data comprising at least parameters relating to motor control of said drive motor arrangement, parameters designating a movement direction of said inkjet print head, and at least one termination criterion for stopping movement of said inkjet print head.

7. An activation method as claimed in claim 6 wherein said motor control parameters are dependent on a type of drive motors included in said drive motor arrangement, and are also dependent on dimensions of said inkjet print head.

8. An activation method as claimed in claim 6 wherein said drive motor arrangement comprises stepper motors, and wherein said parameters designate step counts for operating the stepper motors, including a nominal step count and a movement direction for each of the movement of the inkjet print head in said y-direction and said z-direction.

9. An activation method as claimed in claim 6 wherein said processing apparatus comprises a sensor arrangement that detects a leading edge or a trailing edge of each of said individual items, and using detection of said leading edge or said trailing edge by said sensor arrangement as said termination criterion.

10. A processing apparatus as claimed in claim 6 comprising a sensor arrangement that detects a leading edge or a trailing edge of each of said individual items, and wherein said control processor is configured to use detection of said leading edge or said trailing edge by said sensor arrangement as said termination criterion.

11. A processing apparatus for individual items, comprising:

an inkjet print head;

a drive motor arrangement;

a transport mechanism;

a control processor configured to provide control signals to said drive motor arrangement in order to operate said transport mechanism to transport individual items in the x-direction of a Cartesian coordinate system past said inkjet print head in a printing position so as to execute a printing operation with said inkjet print head on each individual item;

said control processor being configured to provide said control signals to said drive motor arrangement so as to move said inkjet print head in the y-direction of the Cartesian coordinate system into a first position selected from the group consisting of an exchange position at which an exchange operation is implemented to exchange an ink cartridge for said inkjet print head, said printing position, a cleaning position in order to implement a cleaning operation of said inkjet print head, and a sealing position in order to seal said inkjet print head; and said control processor being configured to provide said control signals to said drive motor arrangement to also move said inkjet print head vertically, in the z-direction of said Cartesian coordinate system from said exchange position or said sealing position, into at least one second position selected from the group consisting of said printing position and said cleaning position.

12. A processing apparatus as claimed in claim 11 wherein said control processor is configured to generate said control signals by executing a program that comprises a sub-program that generates control signals for displacing a print carriage of a printing module that comprises said inkjet print head, in order to vertically move said inkjet print head in said z-direction.

13. A processing apparatus as claimed in claim 12 wherein said control processor is configured to repeatedly call said sub-program in order to repeatedly vertically move said inkjet print head in said z-direction.

14. A processing apparatus as claimed in claim 12 wherein said control processor is configured, in said program, to designate said exchange position or said sealing position as a starting position, and executing said program so as to implement startup referencing at a point in time of startup of said processing apparatus, before movement of said inkjet print head into said starting position, when position information is not present in a memory accessible by said control processor, and to move said inkjet print head to a different position from said starting position only when a position of the inkjet print head at said point in time of startup is known to said control processor.

15. A processing apparatus as claimed in claim 12 wherein said control processor, in said program, is configured to execute a further sub-program for moving said inkjet print head in said y-direction, and to repeatedly call said further sub-program for startup referencing.

16. A processing apparatus as claimed in claim 12 wherein said control processor is configured to access movement data for said sub-program from a memory, said movement data comprising at least parameters relating to motor control of said drive motor arrangement, parameters designating a movement direction of said inkjet print head, and at least one termination criterion for stopping movement of said inkjet print head.

17. A processing apparatus as claimed in claim 16 wherein said motor control parameters are dependent on a type of drive motors included in said drive motor arrangement, and are also dependent on dimensions of said inkjet print head.

18. A processing apparatus as claimed in claim 16 wherein said drive motor arrangement comprises stepper motors, and wherein said parameters designate step counts for operating the stepper motors, including a nominal step count and a movement direction for each of the movement of the inkjet print head in said y-direction and said z-direction.

* * * * *